US006026759A

United States Patent [19]

Hazelett et al.

[11] Patent Number: 6,026,759

[45] Date of Patent: Feb. 22, 2000

[54] ADJUSTABLE LEVELING FIN RUDDER METHOD AND APPARATUS FOR POWERBOATS

[75] Inventors: R. William Hazelett; Jeffrey Paul Lefebvre; Timothy D. Kaiser, all of Colchester, Vt.

[73] Assignee: Hazelett Strip-Casting Corporation, Colchester, Vt.

[21] Appl. No.: 09/021,332

[22] Filed: Feb. 10, 1998

[51] Int. Cl.[7] ..... B63H 25/04; B63H 25/06; B63H 25/52

[52] U.S. Cl. ..... 114/144 E; 114/126; 114/144 R; 114/163

[58] Field of Search ..... 114/122, 126, 114/144 E, 144 R, 163, 275; 440/51

[56] References Cited

U.S. PATENT DOCUMENTS

| | | | |
|---|---|---|---|
| 2,892,435 | 6/1959 | Ljungstrom | 114/122 |
| 3,847,348 | 11/1974 | Russ | 114/125 |
| 4,744,322 | 5/1988 | Nakase | 114/144 E |

FOREIGN PATENT DOCUMENTS

| | | | |
|---|---|---|---|
| 37 31 022 A1 | 5/1988 | Germany | 114/144 E |

*Primary Examiner*—Sherman Basinger

*Attorney, Agent, or Firm*—G. Kendall Parmelee; Parmelee & Bollinger, LLP

[57] ABSTRACT

Method and apparatus for leveling or adjusting a powerboat's average angle of bank or list about its roll axis RA regardless of side wind or off-center loading to improve passenger comfort, increase fuel efficiency, and smooth hull passage through waves with reduced pounding. Improved operating characteristics are accomplished by adjusting steering force angle-of-attack of a small fin-rudder mounted under a forward portion of the boat's keel. The boat's heading is maintained by applying an opposite steering force by altering thrust direction of the driving and steering mechanism. Altering thrust direction occurs either by a pilot steering the helm or automatically by adjusting thrust direction independently of pilot steering. In an optional automatic mode, an electronic gravity inclinometer adjusts a fin-rudder servo. An electronic filter processes the inclinometer signal to control the boat's average attitude around its roll axis RA. For providing further automation, thrust direction of the driving and steering mechanism is adjusted substantially simultaneously and proportionally with adjusting fin-rudder angle-of-attack and without pilot steering. The boat's heading is maintained while adjusting fin-rudder angle-of-attack by compensatingly adjusting thrust direction of driving and steering. For further automation, a flux-gate compass controls thrust direction for holding the boat's heading while adjusting fin-rudder angle-of-attack.

26 Claims, 13 Drawing Sheets

ADJUSTABLE LEVELING FIN RUDDER METHOD AND APPARATUS FOR POWERBOATS

FIELD OF THE INVENTION

This invention concerns powerboats, the increasing of their fuel-mileage efficiency, and the improvement of the comfort of their passengers, how said boats are made to sustain an average level attitude around the roll axis, i.e., how to control lateral banking or listing while said boats hold d straight course despite either wind or unevenly distributed contents.

BACKGROUND OF THE INVENTION

Contemporary powerboat hull design favors a deep V configuration to give a smoother ride through waves, however, the V hull design has the effect of reducing the boat's effective beam dimension as the boat, in increasing its speed, rises to a planing position, which position considerably reduces the boat's ability to resist banking caused by steering forces and/or uneven loading.

All pleasure powerboats have steerable propulsion apparatus or propulsion apparatus plus a stern rudder which causes said boats to bank in the direction the helm (i.e., the pilot's wheel or the tiller for steering the boat) is positioned off center. Boats may employ an inboard engine to drive a propellor with a fixed longitudinal drive shaft along with a separate (conventional) stern rudder to steer and bank the boat in the direction of the turn. Or they may combine the propulsion, steering, and banking functions into an outboard drive by angling the propellor thrust to port or starboard to steer the boat. A very popular mechanism of this kind is an inboard engine powering an outboard drive. This is called an IO drive. A less-frequently employed propulsion mechanism pumps sea water rapidly through fore and aft ducts on the bottom of a boat. The resulting jet and its thrust can similarly be diverted to steer and bank the boat. Herein, (1) the steerable propulsion apparatus and (2) the propulsion apparatus plus a stern rudder which options (1) and (2) serve as the two modes of propelling and directing the boat are referred to as the "driving and steering unit." As used herein, the term "driving and steering unit" excludes the helm, electronic controls, and cables or links which move the fin-rudder or move the steerable propulsion apparatus or move the stern rudder.

Over the years, the height of most pleasure powerboats above the resting waterline has increased, while the portion of the hull below the resting waterline has not. An IO drive (or, alternatively for instance, the aft skeg and separate conventional stern rudder of a straight-through drive), will enable the stern of a boat to resist making leeway from the force of a wind component on either side of the boat's course. However, the high topsides of the majority of contemporarily-designed boats cause their bows to make substantial leeway from the force of a side wind component.

To maintain a heading under the above wind conditions, the helm must be positioned to the right of center in order to compensate for a starboard wind component, and to the left of center in order to compensate for a port wind component. The offset of the helm from center will cause the boat to bank undesirably towards the wind direction in order to maintain a selected heading. Said banking projects a flat surface of a V-bottom boat toward oncoming waves, which results in severe pounding. In fact, a V-bottom boat will give a smoother ride in waves seen to be coming from a ten o'clock to two o'clock direction (60 degrees either side of the boat's heading) when the boat is caused to bank about 5 degrees to leeward.

The prior art discloses one device for powerboats up to 25 meters in overall length with means to cause a boat to maintain an average level attitude about its roll axis, by employing port and starboard trim tabs horizontally hinged to the boat's lower transom. Said tabs can be independently moved downward into the fast-passing water to exert an upward leveling force on either the port or starboard side of the boat. This transom double trim-tab concept is only marginally effective in that it does not prevent the leeway drift of the bow, nor does it utilize the practically unlimited force of the boat's driving and steering unit to level the boat or alter the boat's angle of bank or list.

On larger power boats, very powerful large-area, generally horizontal port and starboard fins called horizontal stabilizers are employed. Their angle-of-attack about a transverse axis is automatically and continuously adjustable. Their primary function is to resist the periodic rolling motion of the boat caused by waves, with a secondary function of providing a level attitude about the boat's roll axis.

SUMMARY OF THE DISCLOSURE

Our invention relates only to the control or leveling of a powerboat's average attitude around its roil axis and does not address the periodic rolling motion caused by waves. Embodiments of the invention employ only one small lightly powered adjustable forward downward-protruding fin, or "fin-rudder." Its function is to provide a simple inexpensive mechanism to combine with the angle of thrust of a boat's driving and steering unit to cause said boat to maintain an average level attitude around its roll axis, thereby improving the comfort of the passengers and the fuel-mileage efficiency of a boat. As examples, embodiments of the invention (1) keep a boat in an average level attitude about its roll axis despite uneven or shifting transverse loadings of passengers or cargo, or (2) keep a boat in an average level attitude about its roll axis despite strong winds blowing across the heading of said boat, or (3) intentionally bank V-bottom boats about their roll axis to optimize their entry into wave patterns in order to minimize pounding and permit smoother passage through the waves.

A novel fin-rudder is placed under the forward portion of the boat's keel. It is rotatable by means of a substantially vertical shaft protruding up through the keel and controlled by an actuator capable of aligning said fin-rudder up to 30 degrees clockwise from neutral and up to 30 degrees counterclockwise from neutral as seen looking downward.

A realignment of said fin-rudder will alter a boat's heading, thereby requiring an adjustment of the helm to return the boat to its selected heading. The banking forces resulting from adjusting the boat's helm to an off-center position, and also the force of the fast-passing water against said realigned fin-rudder, work together with the fin-rudder to level a boat around its roll axis.

Systems embodying the invention preferably include an electronic solid-state gravity inclinometer to direct automatically the adjustment of the angle-of-attack of a fin-rudder. In addition, these systems preferably include means to automatically adjust the boat's driving and steering unit to coincide with a proportional alteration in the angle-of-attack of the fin-rudder in order to maintain a course without the pilot's intervention. Further modifications of such systems include automatic holding of an azimuth heading during adjustment of the fin-rudder, by employing a magnetic or a flux-gate magnetic compass having electronic readout of azimuth.

BRIEF DESCRIPTION OF THE DRAWINGS

The following drawings are part of this specification for the purpose of illustrating the principles of the invention. They are not to scale. "DISTAL" means distant from the helm; "PROXIMAL" means at or near to the helm.

DETAILED DESCRIPTION OF THE PREFERRED EMBODIMENTS

The invention will be described in terms of a method, system and apparatus embodying the invention as applied mainly to a pleasure powerboat 10 having an IO (inboard-outboard) drive 25, though embodiments of the invention are applicable to any powerboat that will bank in the direction of a turn.

Figure 1:
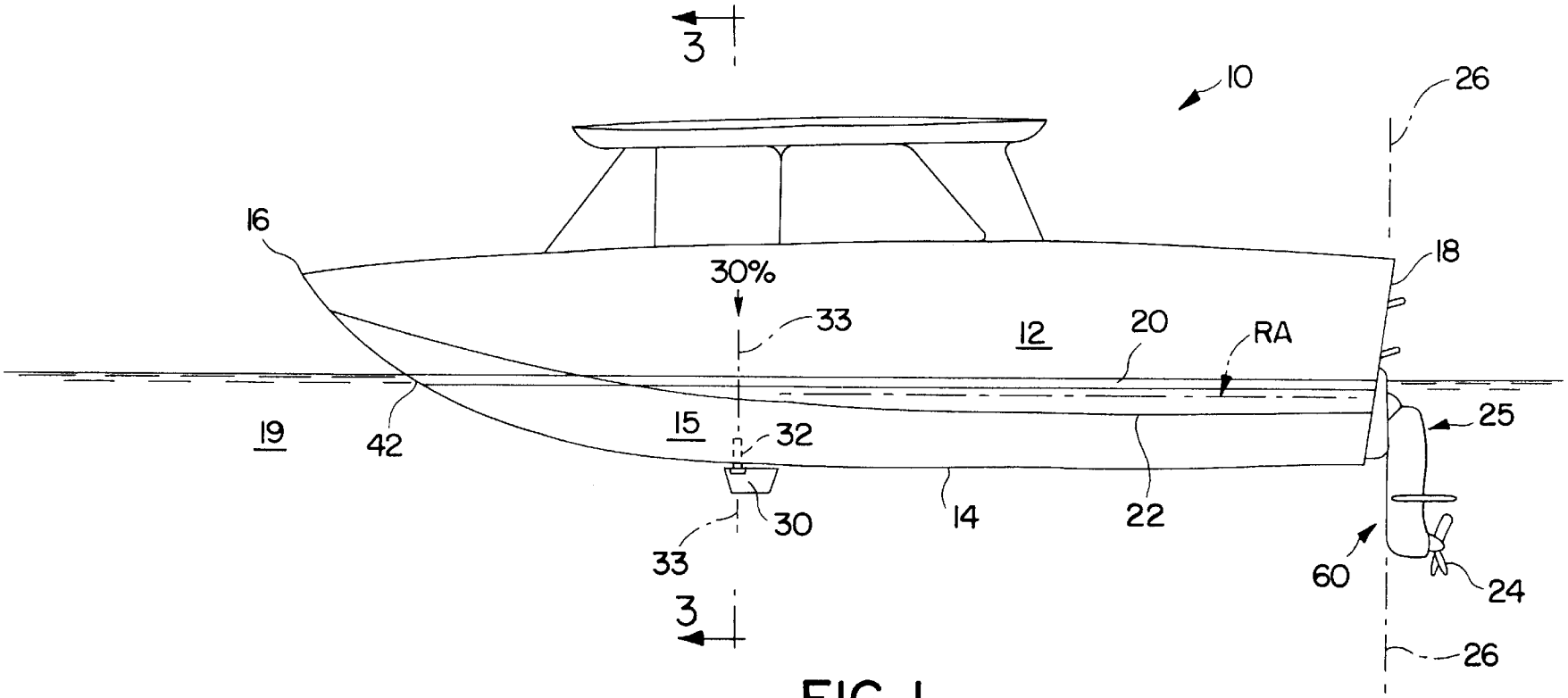
FIG. 1 is a port-side elevation view of a pleasure powerboat with IO (inboard-outboard) drive, which is one kind of boat upon which the present invention may be employed.
Figure 2:
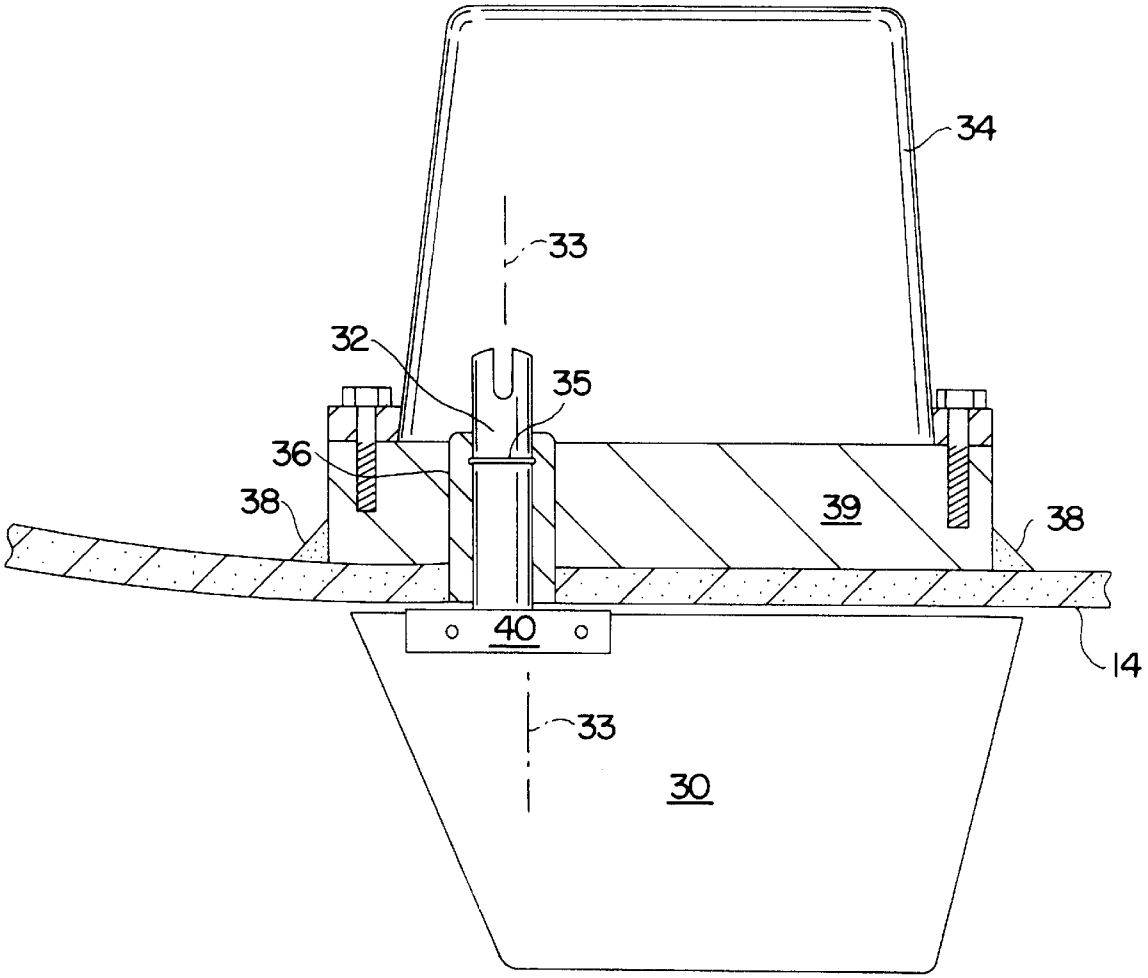
FIG. 2 is an enlarged elevational sectional view of a portion of FIG. 1, for more clearly showing the fin-rudder, its actuating mechanism and its mounting. The hull at the fin-rudder location is shown sectioned at Section line 2—2 in FIG. 3.
Figure 3:
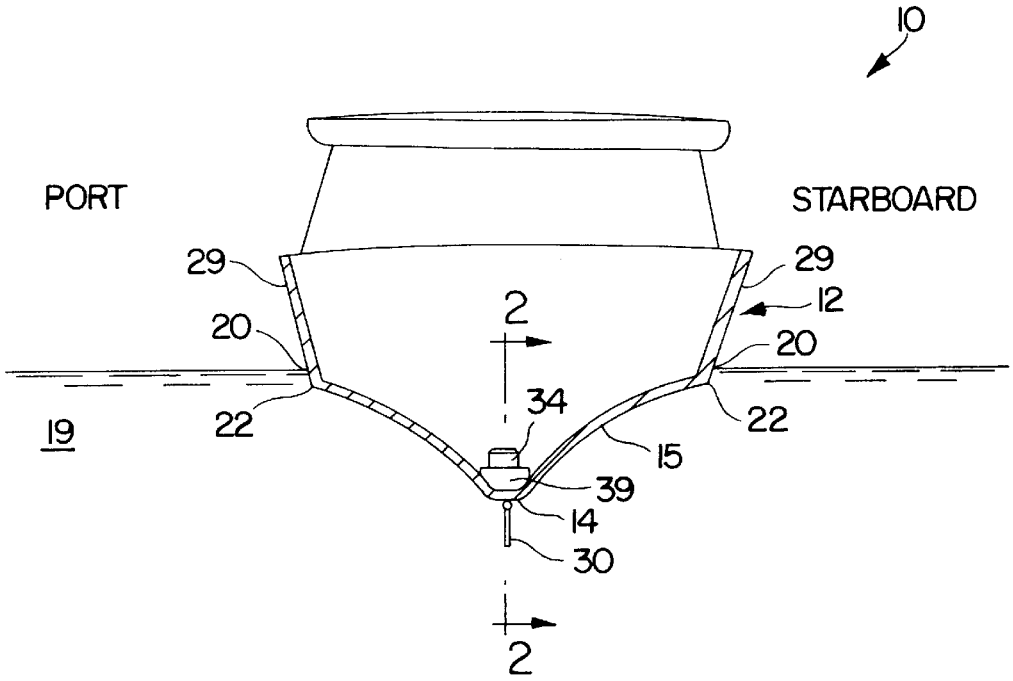
FIG. 3 is a transverse cross-sectional elevational view of the boat of FIG. 1 taken at Section line 3—3 in FIG. 1 looking forward toward the bow of the boat. This Section 3—3 is located about 30 percent of the distance along the length of the boat as measured toward the stern from the hull's forwardmost point of its resting waterline, showing a pronounced V-bottom shape of a hull at this location.
Figure 4:
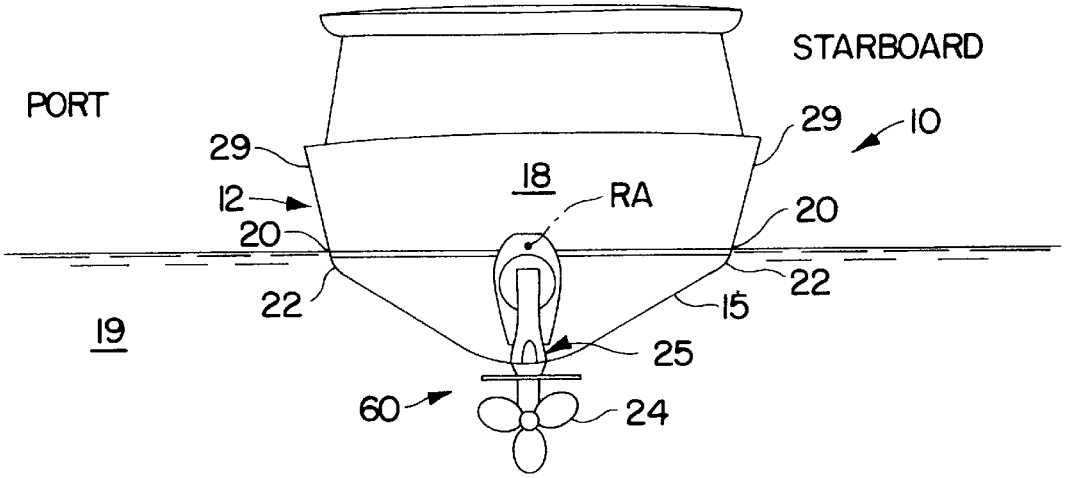
FIG. 4 is a transverse elevational view of the stern of the boat of FIG. 1 as seen looking forward from behind the stern of the boat.

The boat 10 in this illustrative description has a hull 12, a keel 14, which is shown as a center strip along the apex of the hull's V-bottom 15, a bow 16, a transom (stern) 18, a resting waterline 20, and chine 22. The boat is driven by an inboard engine (not shown) as known in the art. The engine is connected in driving relationship to a submerged steerable outboard drive 25 for rotating its propellor 24. The IO drive assembly 25 pivots on a substantially vertical axis 26 for steering the boat (FIG. 1).

Figure 5:
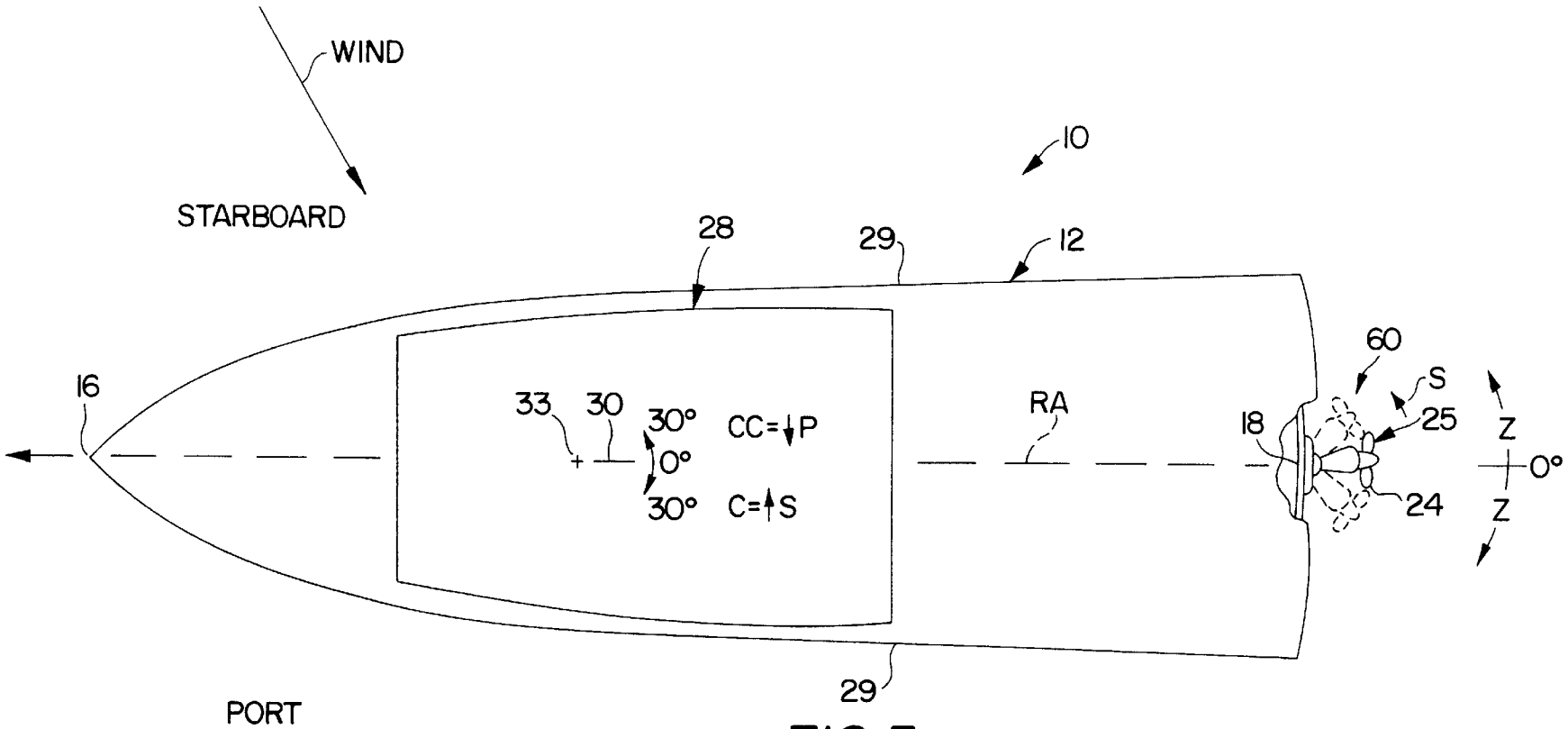
FIG. 5 is a plan view of the boat of FIG. 1 with a portion of the rear deck broken away for showing the stern transom with the IO drive assembly in its center position and also showing in dashed outlines alternate positions of the IO drive when it is turned to left or right of center. Also shown is the neutral submerged position of the fin-rudder.
Figure 6:
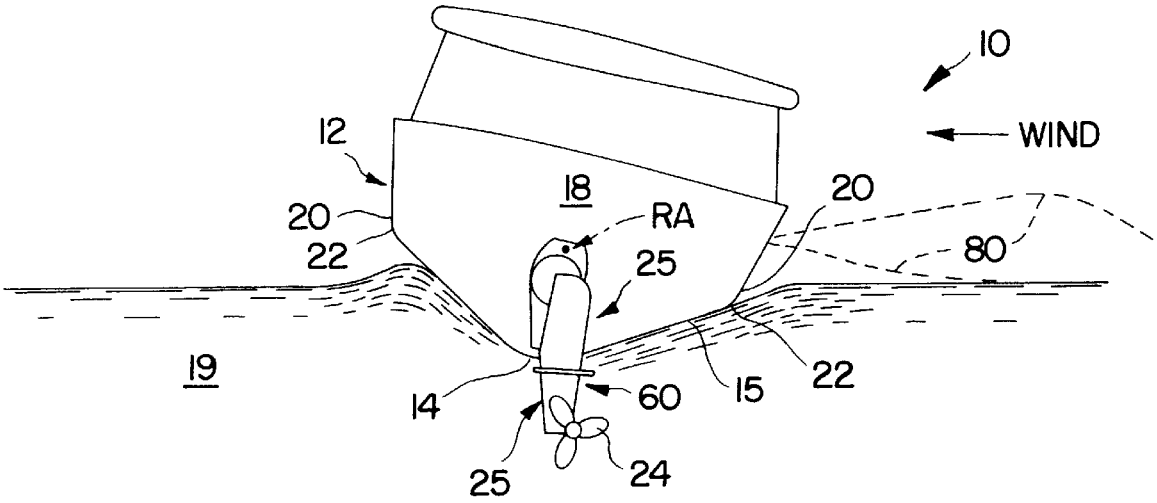
FIG. 6 is a transverse elevational view of the boat looking forward toward the stern as the IO drive of the boat is turning the boat toward starboard.

We have discovered that we can utilize the banking force or torque of a boat's driving and steering unit 60 about the roll axis RA (FIG. 6) to maintain an average level attitude around the boat's roll axis, that is, to adjust its angle of list or bank by the inclusion of a small in-line fin-rudder 30 (FIGS. 1, 2, 3, 5, and 7 through 14) mounted beneath the forward portion of the boat's keel 14. The fin-rudder is attached to the boat through a through-hull rotatable pivot shaft 32 which is substantially vertical and which is actuated in rotation about its centerline 33 by means of any of various electrical or hydraulic or pneumatic actuators 34. The actuator 34 is located inside the hull 12. Said shaft 32 is capable of aligning said fin-rudder 30 from its neutral alignment with the keel 14, in small increments of say 2 degrees up to a suitable maximum angle-of-attack, for example, of about 30 degrees clockwise (FIGS. 5 and 8) and about 30 degrees counterclockwise from said keel alignment.

An additional banking force about the roll axis RA (FIG. 6) is generated by a realignment of the angular position, the angle-of-attack, of said fin-rudder 30, that is, by the side force exerted on the realigned fin-rudder from the fast-passing water 19. However, this additional side force is in fact small in comparison with the much greater banking force from the boat's driving and steering unit 60 when it is turned off center.

Any realignment of said fin-rudder will alter the boat's heading. Returning the boat to its original heading by the boat's helm 74 arid hence the boat's driving and steering unit 60 will create banking forces which can act in concert with said side force exerted against said fin-rudder to level the boat, or achieve a desired angle of bank.

As referred to above, V-bottom boats lose a significant portion of their roll-axis stability as the boat rises to plane. Minor off-center positioning of passengers' weight will cause an unwanted listing condition. For example, if the boat's unsymmetrical loading causes a list to starboard, then rotating our fin-rudder shaft 32 clockwise will cause the bow to veer off course to starboard. To maintain a selected course, the helm 74 must then be offset to port. This port steering offset will cause the IO drive 25, or thrust of propellor 24 against a conventional stern rudder 75, i.e., the driving and steering unit 60, to exert a correcting banking force to port. In addition, the fin-rudder 30 will exert a relatively minor leveling force about the boat's roll axis RA toward port. These two forces combine to level the boat or provide a desired angle of bank or list.

As referred to above, a side wind will cause the bow of a boat to drift to leeward while the boat's stern will resist drifting to leeward. Adjusting the helm to offset said drifting and thereby maintaining a boat's course will cause the boat to bank to starboard if the helm is adjusted to the right and bank to port if the helm is adjusted to the left.

Realigning our fin-rudder towards the direction of said side wind will eliminate the drift of the boat's bow to leeward and permit returning the the boat's helm 74 and the driving and steering unit 60 back to center and thereby cancel the unwanted banking force of the boat's driving and steering unit and cause the boat to attain an average level attitude around its roll axis, resulting in passenger comfort aid maximum fuel efficiency.

In yet another aspect of the invention, assume that a stiff wind is impinging at an angle of about 60 degrees from starboard as encountered by the moving boat relative to the boat's intended heading. The ultimately desirable result would be to bank (tilt) the boat not merely back to level but beyond level, that is, slightly toward leeward, toward port, thereby tilting and aiming the lower part of the apex of the V-bottom shape somewhat toward windward (starboard) so that the V shape would optimally cut through crests of waves 80 approaching from windward and so minimize the pounding of the windward half-surface 15 of the V hull against approaching wave crests. A further adjustment of the fin-rudder 30 and corresponding adjustment of the helm 74 and hence the boat's driving and steering unit 60 accomplishes this.

The pivot shaft 32 is attached to the fin-rudder 30 at a point forward of the fin-rudder's fore-and-aft mid-point. This shaft is attached to the fin-rudder 30 by means of a metal clamping member 40. In its neutral position, the fin-rudder 30 is in line with the keel 14. A mounting and sealing base block 39 captures and provides a housing for the waterproof shaft bushing 36. The base block 39 is attached to a fiberglass hull 12 by epoxy cement 38 or by other means as may be appropriate. An O-ring 35 seals the shaft 32 against the bushing 36.

For the majority of boat designs, a suitable mounting position of said fin-rudder 30 is about 30 percent of the boat's underway waterline length back from the most forward immersible point of the boat's hull when the boat is under way, with a minimum and maximum suitable range of between 15 percent and 45 percent, depending on the shape of the hull, the boat's weight and its average speed. The ratio of the effective leveling force of the boat's driving and steering unit 60 to the effective leveling force of the fin-rudder 30 can be altered by changing the fore and aft mounting position of the fin-rudder.

The area of the fin-rudder 30 is mainly dependent on the boat's overall length, and to a lesser extent its weight and the hull design below and above the resting waterline 20, as well as its average speed through the water. In addition, the type of propulsion is also a factor, i.e., outboard drive, inboard/outboard drive 25, straight drive, or jet drive. An approximate area for a fin-rudder 30 for all powerboats can be determined by multiplying the boat's overall length in meters by 25 in order to obtain said fin-rudder's area in square centimeters. We have found a suitable minimum and maximum range of fin-rudder area in square centimeters to be determined by multiplying a boat's designed resting waterline length in meters by a number in a range from about 15 to about 65, respectively. The most desirable combination of said fin-rudder's area and its fore and aft location on the boat's keel for a particular boat design can be best determined by sea trials.

Figure 7:
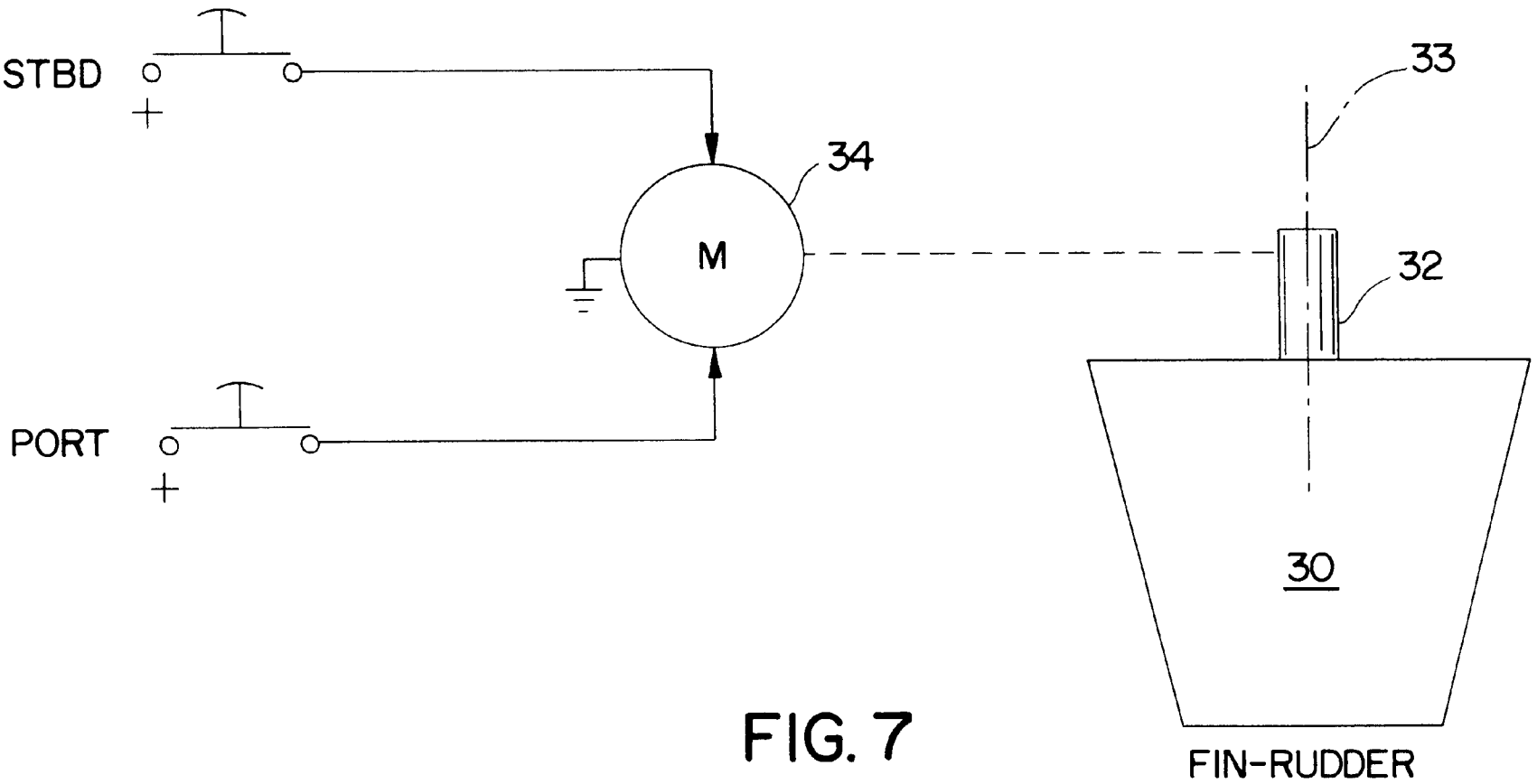
FIG. 7 is a simplified block diagram showing an average-leveling control system embodying the invention under remote control and reduced to its simplest terms.

FIG. 7 shows two electrical switches to operate servo motor 34 and so to turn the fin-rudder 30 at the will of the pilot or operator. An example of the actuator 34 to adjust the fin-rudder 30 is a readily available servo motor, namely, a simple automobile 12-volt DC power-window raising/lowering motor apparatus. For simplicity of explanation, actuator 34 has been shown located in the bilge, though if it be electric, it is preferably located higher, turning the fin-rudder by remote mechanical control as through a flexible cable.

Figure 8:
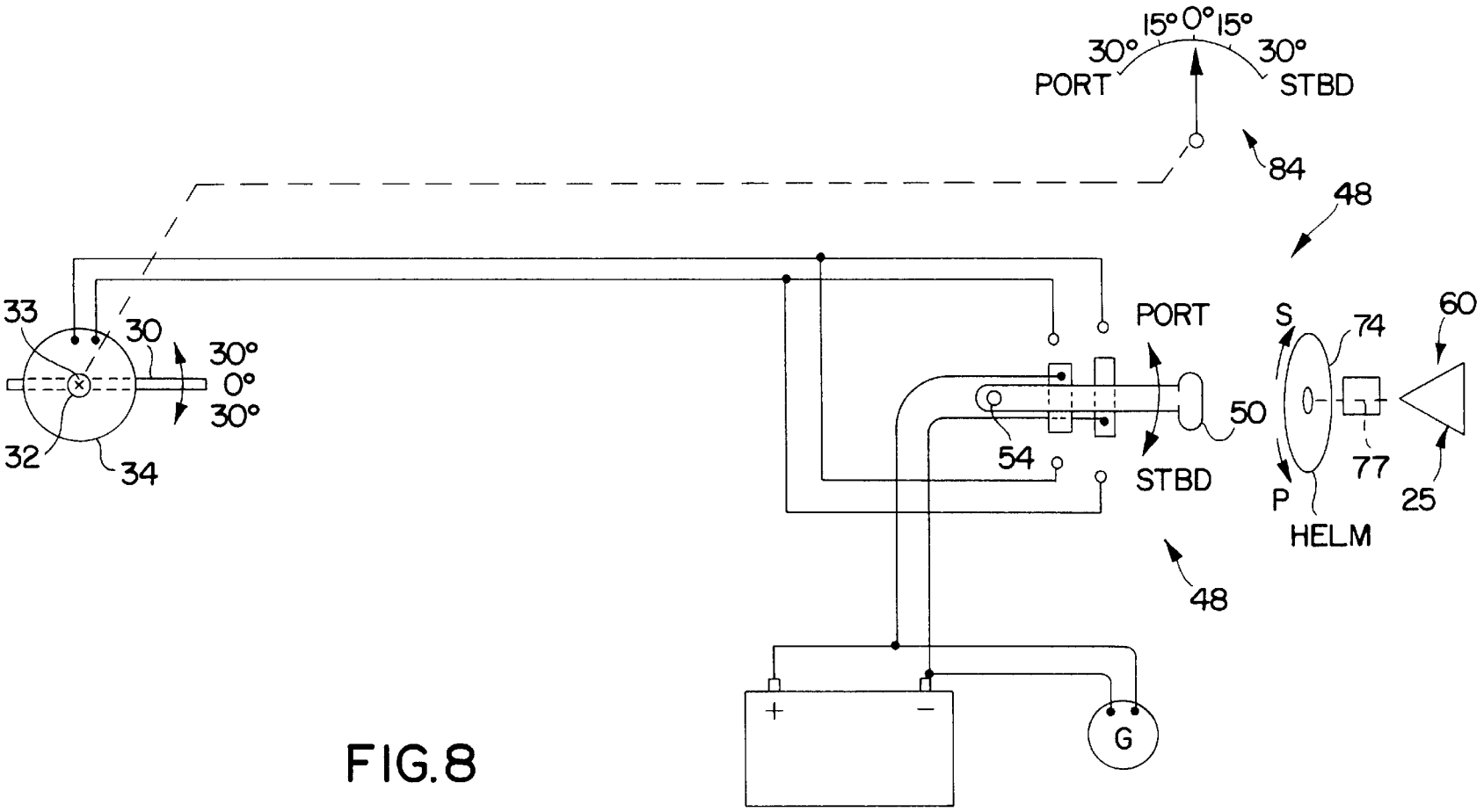
FIG. 8 covers the functions of FIG. 7 but is a detailed schematic block diagram showing an average-leveling control system with a two-way switch and embodying the invention. The helm and steering apparatus are symbolized to the right.

FIG. 8 shows the servo motor or actuator 34 being manually controllable by a spring-return switch 48 with a handle and pointer 50 which is neutral in its mediate resting position, normally vertical. This switch 48 can provide incremental fin-rudder alterations of its angle-of-attack per FIG. 7. The handle 50 is pivoted at 54. Moving the handle 50 to its left energizes the servo actuator 34 to turn the fin-rudder 30 to steer to left or port; this adjusting movement continues so long as the handle 50 is held to the left. Moving the handle 50 to the right does likewise but in the opposite direction. A fin-rudder position-meter is shown at 84. P is port and S is starboard. Other elements of FIG. 8 will be understood by those who are skilled in the art of electrical control.

Figure 9:
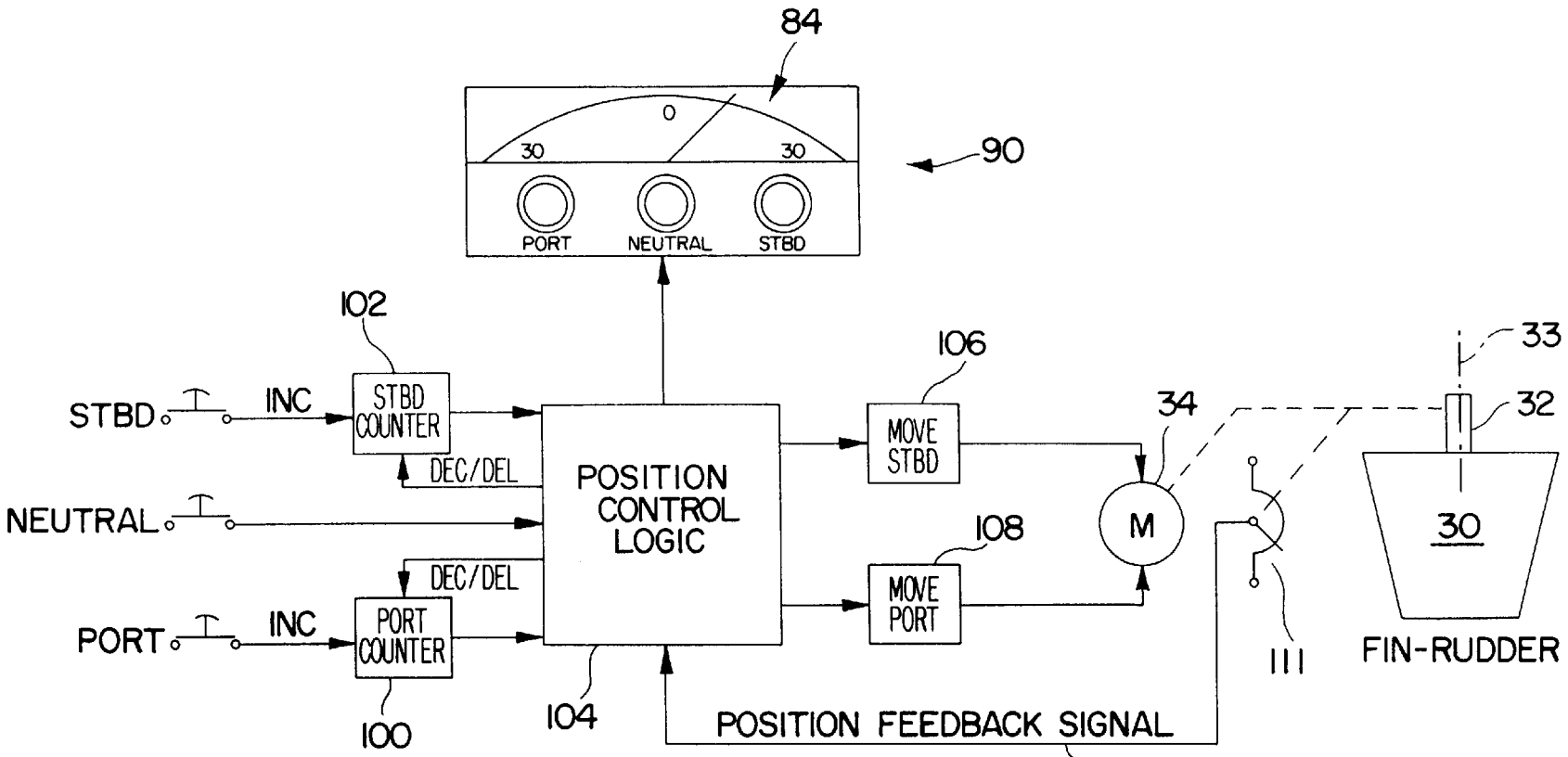
FIG. 9 covers the functions of FIG. 8 but with a push-button command apparatus instead of a simple two-way switch.

Referring now to FIG. 9, the switch 48 is replaced by a 3-button control panel 90, which includes position-meter 84. Each momentary press of the buttons marked PORT and STBD (each button is shown at two places in FIG. 9) closes a respective switch which causes the fin-rudder 30 to move 2 degrees in the respective direction. Repeated momentary presses of these buttons will cause repeated 2-degree increments of motion. Pressing and holding either the STBD or PORT button will cause the fin-rudder 30 to rotate constantly as commanded until the button is released or until the selected limit, preferably 20 degrees, or a maximum of 30 degrees, is reached. Pressing the button marked NEUTRAL will immediately cause the fin-rudder to move amidships, to zero position on meter 84.

Each press of the PORT button registers an increment INC—is incremented—in a dedicated port counter 100, and likewise for the STBD button and its starboard counter 102. A non-zero value in each counter will induce a 2-degree move of fin-rudder 30 in the respective counter's direction. As each move of the fin-rudder is completed, the respective counter is decremented (DEC/DEL) until the counter's value is zero. With each counter at a value of zero, no motion of the fin-rudder 30 is called for. The outputs of the counters are inputted to a position-control logic block 104. This block interprets each counter value in terms of desired rotational position or angle-of-attack of the fin-rudder. A count of 5 in the starboard counter 102 (5 momentary presses of the STBD button) is interpreted as calling for a 10-degree to starboard alteration of fin-rudder position, and five 2-degree incremental moves of fin-rudder 30 must occur. The position-control logic block 104 causes an output circuit to energize the fin-rudder actuator M or 34 in the appropriate direction through the blocks "move starboard" 106 and "move port" 108. Specifically, the position-control logic block 104 commands the "move starboard" or "move port" blocks to energize the respective outputs for a distinct period of time for each count-value. This distinct period of time corresponds to a distinct angular position alteration. Alternatively, the position-control logic block 104 controls the fin-rudder by means of a feedback signal 109 from a potentiometer 111 attached to the fin-rudder motor 34.

Upon pressing the NEUTRAL button, all port-starboard moves are disabled, the respective counters are set or decremented to zero, and the position-control block 104 energizes the correct output to cause the fin-rudder to move to the neutral, or amidships, position.

The aforementioned logic blocks may be realized in any number of ways. For example, simple, low-cost logic processors are readily available in today's control-electronics market. Processors from Rockwell Automation, Eden Prairie, Minn. 55344 or from PLC Direct by Koyo, 3505 Hutchinson Road, Cumming, Ga. 30040, will serve. Each contains programmable memory which executes sequential instructions designed to perform counting, comparison and output-energizing logic required by our device. Such logic may also be realized by utilizing discrete semiconductor devices such as binary counters, logic gates and digital comparators, all available from many semiconductor manufacturers. These devices, connected together on a printed-circuit board following design rules common to those versed in electronics design, willperform all logic required by our device.

Figure 10:
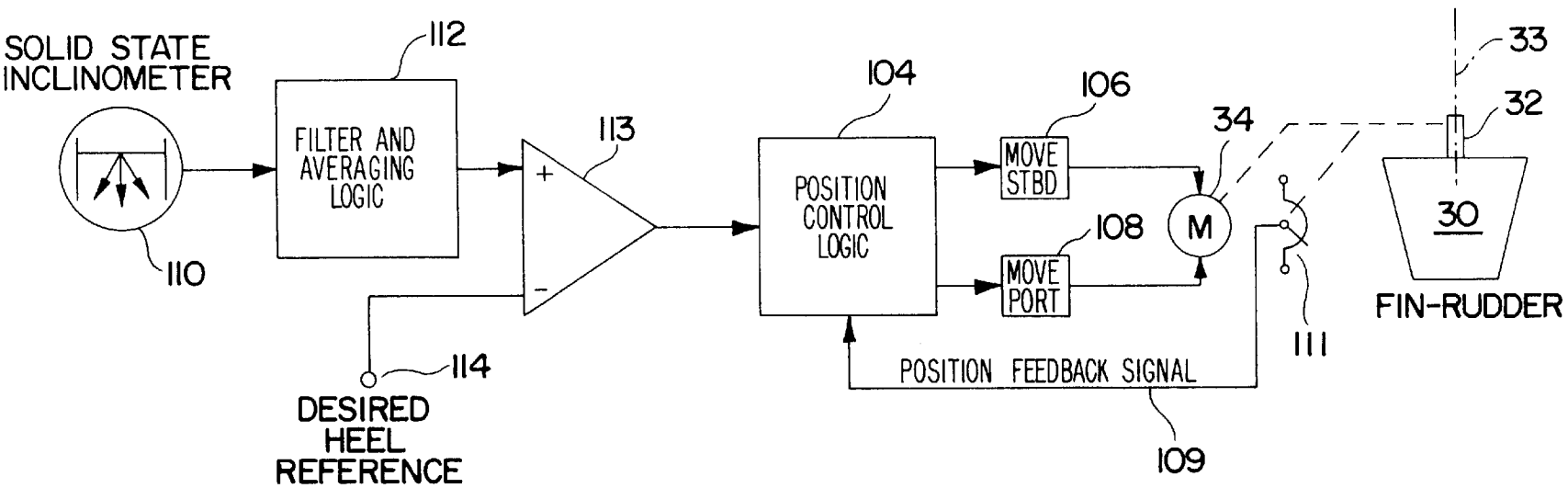
FIG. 10 is a schematic block diagram showing a boat average-leveling control system embodying the invention and being automatically responsive to control signals provided by a gravity inclinometer and an electronic filter.

In FIG. 10 automatic control is achieved by means of a signal derived from an electronic solid-state gravity inclinometer 110. This derived output signal represents the boat's current average heel or list angle, that is, its average current orientation around its roll axis RA. The use of electronic filtering techniques and moving average algorithms in the block filter and averaging block 112 provides a signal representing the vessel's average heel or list angle, a signal with smoothings and corrections which render the signal free also from the instantaneous effects of the still-present wave-induced momentary excursions around the boat's pitch axis (transverse) and yaw axis (vertical). These axes are not shown on the drawings as they depend on the planing attitude of the boat. The internal circuits, programming and software are such as are commonly used in the art of signal processing.

The average heel or list signal 116 coming from the block filter and averaging block 112 is compared in a comparator 113 to a value representing "desired heel reference" 114, and the difference is presented to a block of circuitry responsible for moving the fin-rudder which is labeled "position control logic" 104. If the average heel was to starboard, then to level the boat the fin-rudder would be commanded to rotate to starboard; if to port, then to port. If some heeling is desired, as discussed above for optimum cutting through waves from one side, then the "desired heel reference" 114 is adjusted to the desired value of heel or list.

The amount of rotation of the fin-rudder 30 would be in direct proportion to the amount of average heel signal 116. As in the previous FIG. 9, the position control block 104 may emit signals of durations of action to "move starboard" and "move port" blocks (106, 108), which signals reflect the count-values that were inputted, as described above for FIG. 9. Alternatively as before, the position-control logic block 104 controls the tin-rudder by a feedback signal 109 from a potentiometer 111 attached to the in-rudder actuator 34, furnishing a closed-loop control.

Electronic solid-state gravity inclinometers are available from Lucas Control Systems Products, 1000 Lucas Way, Hampton, Va. 23666. Another form of electronic gravity inclinometer is a resistive potentiometric type utilizing impedance change due to a bubble moving in an electrolytic fluid, such as those available from Spectron Systems Technology, 595 Old Willets Path, Hauppage, N.Y. 11788.

Each alteration of the angular position of the fin-rudder 30 changes the heading of the boat and begins the leveling process. To alleviate the need to manually adjust the helm 74 when the fin-rudder angle-of-attack alters, a further stage of automation is provided which simultaneously, or nearly so, turns the driving and steering unit 60 in proportion to the progress of the movement of the fin-rudder 30. The pilot maintains manual steering control with the helm 74. The proportional adjustment of the driving and steering unit 60 is in response to, and corresponds with, the motion of fin-rudder 30 and occurs independently of manual steering control from the helm 74.

Figure 11:
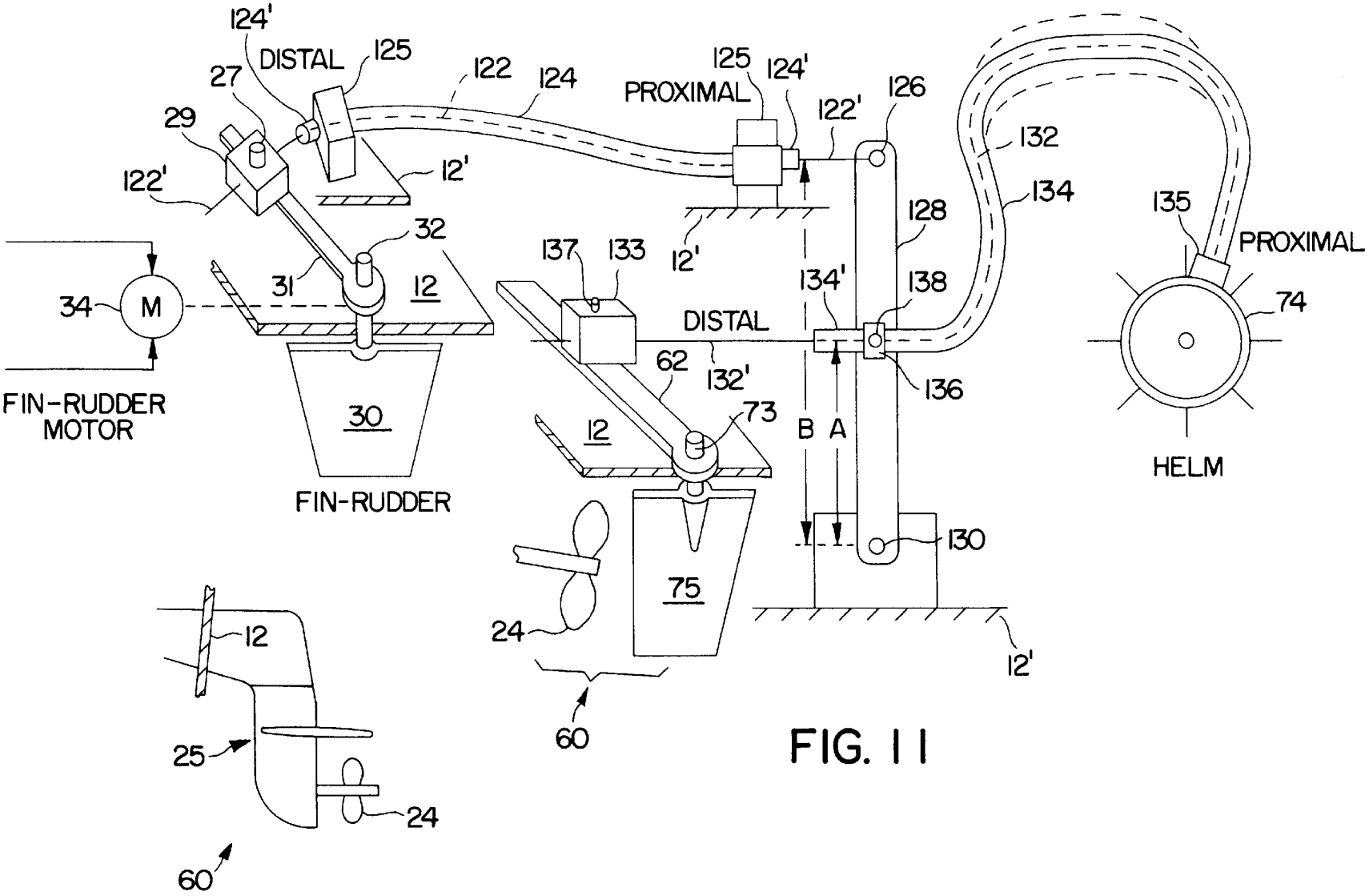
FIG. 11 is a schematic block diagram which builds on the command controls of FIGS. 7, 8 or 9 with the additional feature of proportioned mechanical cooperative positioning of the driving and steering unit as influenced by both the fin-rudder and the helm.
Figure 12:
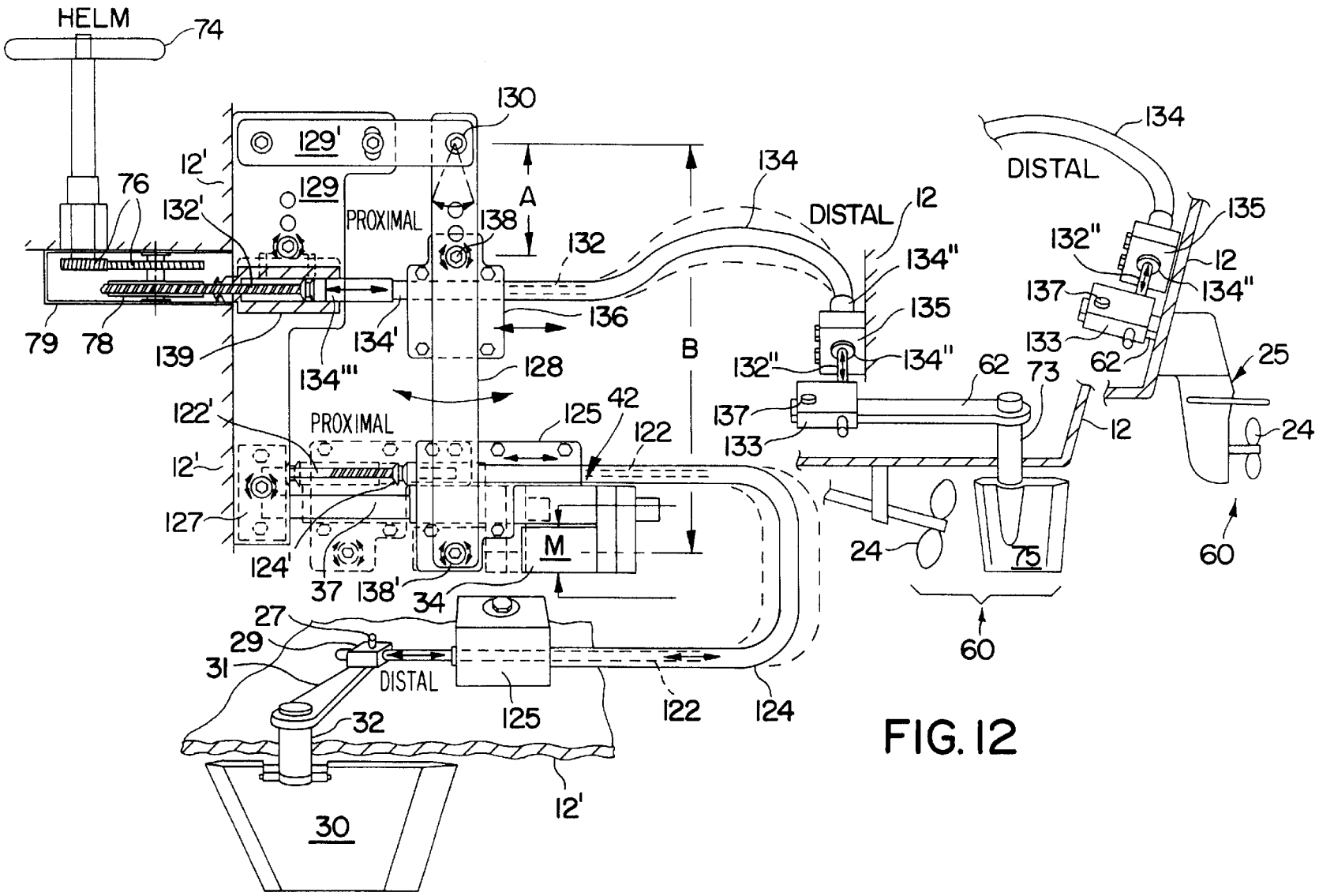
FIG. 12 is a semi-conceptual diagram of an embodiment having the same result as FIG. 11.

This advanced automatic system is shown embodied in a mechanical linkage illustrated in FIG. 11 or FIG. 12, which show respectively two of the many possible configurations that may be employed to control the plurality of steering inputs. In such configurations, motion of the fin-rudder 30 is mechanically linked to the driving and steering unit 60 through a proportioning lever 128 pivoted at one end by fixed pivot 130 (FIGS. 11 and 12). In FIG. 12 proportioning lever 128 is pivoted to stationary member 129 through bridge piece 129'. To this end, a cable 122 starting distally at a fin-rudder lever 31, and secured there by clamp 29 and cable-securing screw-pivot 27, may be configured in a non-straight path. This cable 122 has a slidable sheath 124 with ends 124' fixed in clamps 125. Motor 34 (FIG. 12) is operated in any of the ways as shown in FIGS. 7, 8, 9 or 10, and it powers a fin-rudder linear actuator 42. This linear actuator 42 extends or retracts its movable push-rod 37, thereby turning the fin-rudder 30 as explained later. Linear-actuator 42 is a general-purpose actuator obtainable from Warner Electric/Dana, 449 Garden Street, South Beloit, Ill. 61080. In FIG. 12 self-movement of the whole linear actuator 42 is caused through securing of a projecting end of push-pull rod 37 into a stationary terminating block 127. In FIGS. 11 and 12, reference number 12' indicates fixed structure effectively attached to the hull.

Proximal clamp 125 in FIG. 11 is secured to structure 12'. In FIG. 12, however, proximal clamp 125 is mounted to the movable end of lever 128 by pivot 138'; and this proximal clamp 125 is attached to linear actuator assembly 42. Thus, extension and retraction of push rod 37 causes lever 128 to swing about its fixed pivot 130, causing the proximal clamp 125 to move back and forth as indicated by a double-ended arrow on this clamp 125. The ends of cable 122 are numbered 122', and in FIG. 11 the proximal end is secured to pivoted connection 126 on lever 128.

In FIG. 12 cable end 122' is secured to stationary member 129 by the terminating block 127. The helm 74 in FIG. 11 is connected to the proximal protruding end 132' of flexible steering cable 132 slidably contained within flexible, longitudinally-rigid hollow sheath 134 of which the end is secured by clamp 135 to the helm pedestal. In FIG. 12, the action of the helm is shown involving gearset 76 and cable traction wheel 78 in gearbox 79.

In FIG. 11, the distal end 134' of cable sheath 134 is clamped by clamp 136, which is pivoted to lever 128 by pin 138. Hence, moving the lever 128 or otherwise moving sheath 134 changes the path length of cable 132. In FIG. 12, a machined fitting 134''' at the proximal end 134' of cable sheath 134 slides freely in bronze bushing 139 pivotally connected to lever 129 for accommodating adjustment of clamp 136 along lever 128 for adjusting steering ratio A/B. The distal end of cable sheath 134 is numbered 134'' and is effectively clamped to the hull 12 at 12' by clamp block 135. The distal end 132'' of non-straight flexible cable 132 steers the driving and steering unit 60 through clamp block 133 pivoted by pivot 137 to lever 62 secured to shaft 73 of stern rudder 75. Cable sheath 134 and hence cable 132 follow a variable path per the curved dotted lines depending on the position of proportioning lever 128.

In case of need, the pilot always can use the helm 74 to surpass the limited steering corrections coming from the fin-rudder actuator 34.

The steering ratio of lengths A/B on lever 128 from fixed pivot 130 in FIGS. 11 and 12 is adjustable by moving pivot connection 138 along the lever 128 to accommodate differing vessel sizes and configurations, but this ratio is fixed, once it is suitably determined for a particular vessel. Increasing the steering ratio A/B provides a proportionally increased charge away from neutral (0° in FIG. 5) of the lateral thrust angle "Z" of the driving and steering unit 60 for a given increase in angle-of-attack of fin-rudder 30, and vice versa.

Figure 13:
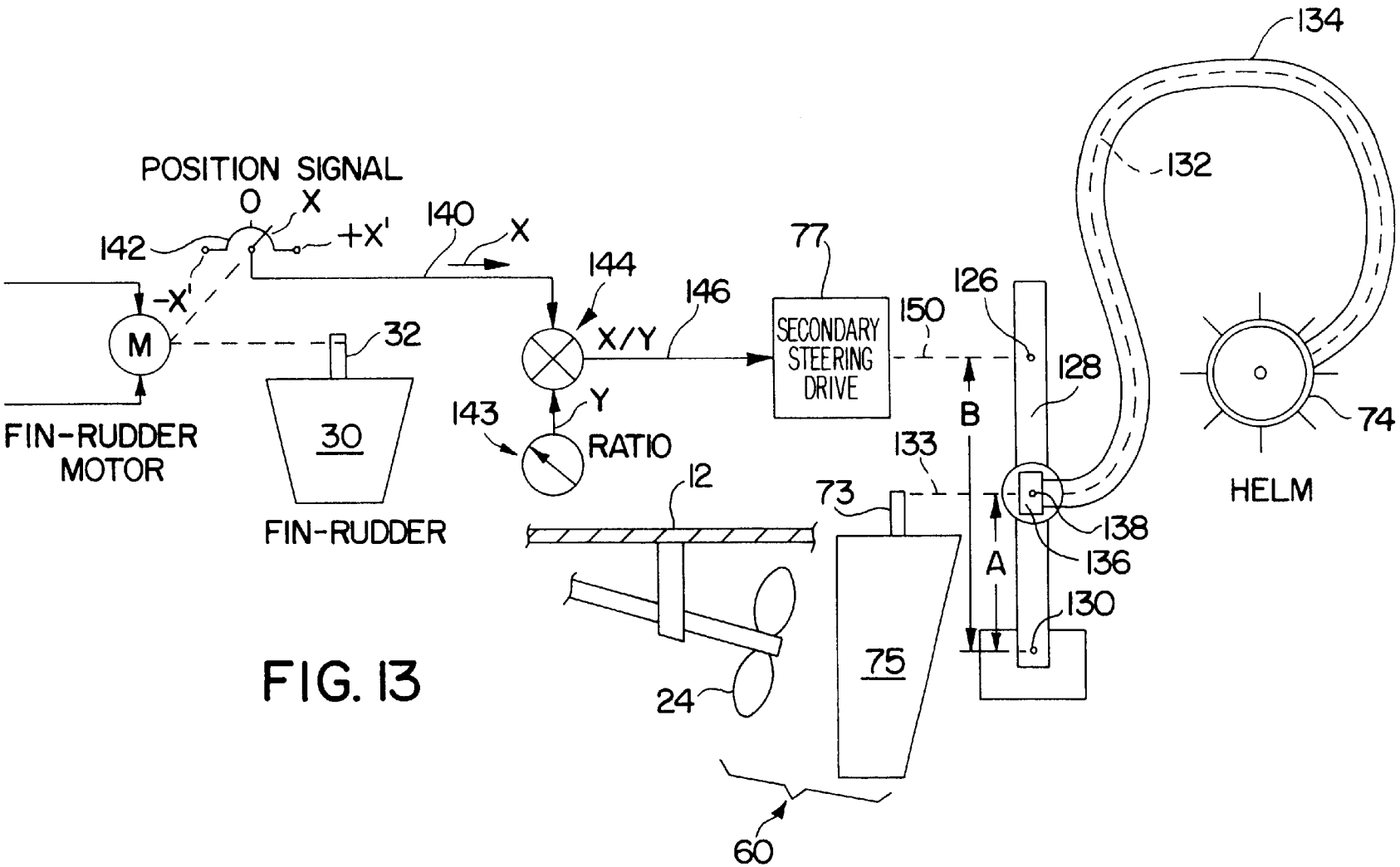
FIG. 13 is a schematic block diagram like FIG. 11 but with the cooperative motion carried out electrically.

The mechanical cable and sheath linkage 122 and 124 from the fin-rudder actuator 34 to pivot 126 (FIG. 11) is replaceable by an electronic linkage as shown in FIG. 13. A potentiometer 142 provides a signal "X" proportional to the angle-of-attack of the fin-rudder. The signal X becomes +X' at one extreme of the fin-rudder's rotation and −X' at its other extreme of rotation. As indicated by arrow 140, this angular position signal X is fed to a ratio detector circuit 144. This circuit 144 receives input of a signal "Y" from a source 143 for providing an adjustable electrical proportionality constant Y, which achieves an electrical steering ratio adjustment analogous to mechanical adjustment of the steering ratio A/B in FIGS. 11 and 12. This adjustable proportionality constant signal Y is adjusted to a value well suited for a particular motor boat. Once this well-suited value of signal Y is determined for a particular boat, this signal Y is fixed in value. The signal Y is applied at 144 for generating a ratio signal X/Y which at its maximal value is X'/Y, which in turn is proportionately different from maximal signal X' alone, just as mechanical movement applied at lever length B results in lateral movement of point A on the lever in the ratio A/B which is proportionately different from length A alone. The actual ratio signal X/Y serves as a motion-command signal 146 sent to an actuator 77 (secondary steering drive) which comprises a secondary motor or hydraulic cylinder. This actuator 77 has its actuating link 150 connected to the lever 128 at pivot 126. Thereby, the driving and steering unit 60 is turned.

Figure 14:
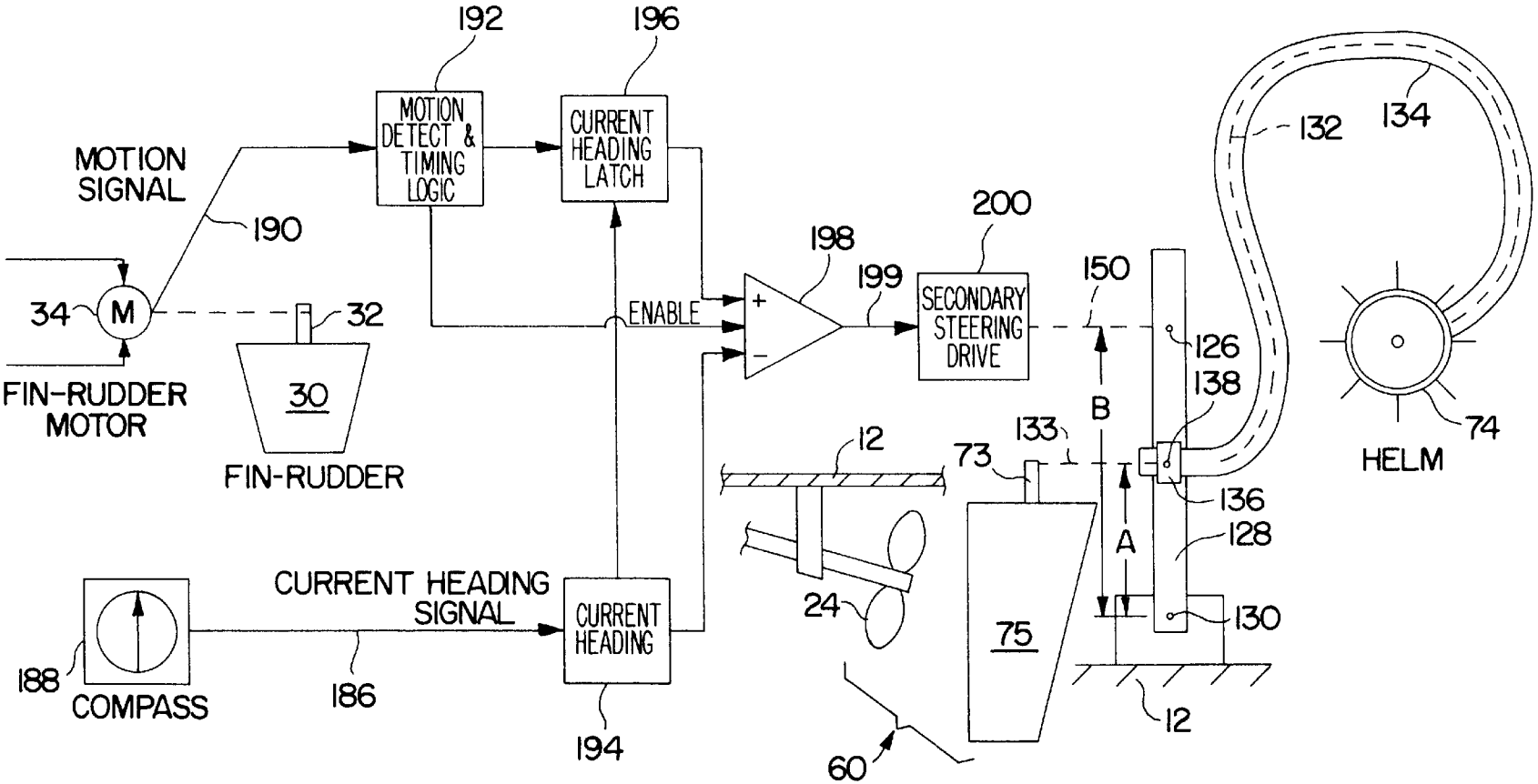
FIG. 14 is a schematic block diagram which builds on the command controls of FIGS. 7, 8 or 9 with the additional feature of being responsive to control signals provided by a flux-gate compass but only during the time in which the fin-rudder is being adjusted.

FIG. 14 shows another, more precise way to automatically hold the heading of a boat to a predetermined azimuth while the fin-rudder 30 is being turned, i.e., while its angle-of-attack is being changed. In FIG. 14 we replace the open-loop ratio control of FIG. 13 and provide instead a current heading signal 186 derived from a compass 188, such as a flux-gate compass as is commonly used in autopilot devices.

Whenever the fin-rudder 30 starts to move, whether automatically by compass control as shown in FIG. 10 or manually as is shown in FIG. 7, 8 or 9, a motion signal 190 (FIG. 14) causes the current heading signal (bearing signal) 186, 194 of the vessel to be temporarily captured or "latched" as indicated at 196. As the boat veers away from this latched course due to alteration of angle-of-attack of the fin-rudder 30, the vessel's current heading 194 begins to differ from this latched bearing 196. The difference or comparison between the latched bearing and the current bearing provides from comparator 198 a signal 199 fed to a secondary steering drive 200 to command a change in the direction of thrust of the driving and steering unit 60 so as to return the vessel to the latched heading. This command signal 199 is used by an electric motor or a hydraulic cylinder in secondary-steering drive 200 to move, through link 150, the driving and steering unit 60 independently of the boat's helm 74.

While the fin-rudder 30 is undergoing rotational alteration (change in its angle-of-attack), the above-mentioned motion signal 190 so informs the "motion detecting and timing logic" 192 and thereby enables (as shown by arrow 193) the comparator 198 to command the secondary steering drive 200 during the period of fin-rudder motion. The signal 199 to the secondary steering drive 200 ceases operation at a predetermined brief time interval after the fin-rudder 30 completes an alteration in its angle-of-attack. This brief time interval is long enough to allow the vessel to respond to righting forces around its roll axis RA. Because distinct changes in angle-of-attack of the fin-rudder, and hence also the signals 199 to the secondary steering drive 200, result solely from changes in heel sensed by an inclinometer 110 as is shown in FIG. 10, the vessel's principal heading continues to be strictly maintained by the vessel operator, or by an engaged automatic pilot, even while changes in angle-of-attack of the fin-rudder are occurring. After the aforementioned brief interval, the motion signal 190 ceases and the comparator 198 is disabled, ceasing any further action of the secondary steering drive.

A suitable embodiment of our rotatable stabilizing fin-rudder invention is a highly desirable addition to a contemporary powerboat. Applications of our invention will work with any powerboat where positioning the helm off center causes the boat to bank or tilt in the direction of the turn. The only other popular available device to make leveling corrections on powerboats up to about 25 meters in overall length are the transom trim tabs, as discussed earlier, but they do not provide numerous operating advantages and features as described for the embodiments of our invention.

It has been determined that embodiments of our invention as described work best in power boats up to about 25 meters in overall length and capable of speeds of more than about 20 kilometers per hour.

We claim:

1. The method of controlling average list about its roll axis of a forward-moving powerboat capable of speeds in excess of about 20 kilometers per hour and of an overall length generally under about 25 meters and having a driving and steering unit, the method comprising the steps of:

providing a small fin-rudder located under a forward portion of the powerboat's keel, mounting said fin-rudder to a rotatable shaft extending upwardly into the powerboat and capable of rotating said fin-rudder about an upwardly extending longitudinal axis of said shaft a maximum of about thirty degrees clockwise or counterclockwise as seen from above on either side of a neutral position, said neutral position being said fin-rudder's fore and aft alignment with said keel, thereby providing a range of adjustment of an angle-of-attack of said fin-rudder between about 30° clockwise and about 30° counterclockwise relative to oncoming water resulting from forward moving of the powerboat, for altering toward port an average list of the forward-moving powerboat about its roll axis as seen from astern of the powerboat adjusting the angle-of-attack of said fin-rudder in the clockwise direction for exerting a steering force toward starboard while also exerting on the forward-moving powerboat a counterclockwise banking force around its roll axis as seen from astern, substantially simultaneously with adjusting in the clockwise direction the angle-of-attack of said fin-rudder also adjusting in the clockwise direction as seen from above the direction of thrust of the powerboat's driving and steering unit for exerting a steering force toward port to counteract the steering force toward starboard being exerted by the clockwise adjusted angle-of-attack of said fin-rudder for maintaining the powerboat's heading, and utilizing a counterclockwise banking force around the forward-moving powerboat's roll axis as seen from astern resulting from the clockwise adjusted direction of the direction of thrust of the powerboat's driving and steering unit acting in cooperation with the aforesaid counterclockwise banking force around the powerboat's roll axis being exerted by the clockwise adjusted angle-of-attack of said fin-rudder for altering toward port the average list of the forward-moving powerboat around its roll axis while maintaining the powerboat's heading; and vice versa for altering toward starboard an average list of the forward-moving powerboat about its roll axis as seen from astern of the powerboat, whereby steering forces in opposite directions being exerted by the angle-of-attack of the fin-rudder and being exerted by the thrust direction of the driving and steering unit counteract each other for maintaining the powerboat's heading, and whereby banking forces in the same direction around the roll axis of the powerboat being exerted by the angle-of-attack of the fin-rudder and also being exerted by the thrust direction of the driving and steering unit act in cooperative additive relation for controlling the average list of the powerboat about its roll axis as seen from astern.

2. The method as claimed in claim 1 including a further step of overcoming an unwanted list of the powerboat when being subjected to a side-wind component.

3. The method as claimed in claim 1, including a further step of:

employing an electronic output of a gravity inclinometer to indicate average list of the powerboat around its roll axis, and by said indication of average list of the powerboat around its roll axis automatically actuating a servo mechanism attached to said fin-rudder shaft, for adjusting an average angle-of-attack of said fin-rudder.

4. The method as claimed in claim 3, wherein the powerboat has a helm controlled by an operator for steering the powerboat, including the further step of:

automatically adjusting the direction of thrust of the driving and steering unit substantially simultaneously and proportionally with adjusting the angle-of-attack of the fin-rudder, without disturbing the operator's control of the helm.

5. The method as claimed in claim 3, wherein the powerboat has a helm controlled by an operator for steering the powerboat, including additional steps of:

employing a compass in an electronic circuit for providing an electronic indication of deviation of heading of the powerboat from a predetermined azimuth, and using said electronic indication in order to hold a heading of the powerboat automatically only during adjustment of the angle-of-attack of the fin-rudder and without disturbing the operator's control of the helm.

6. The method of controlling the average unwanted list about its roll axis of a forward-moving powerboat capable of speeds in excess of about 20 kilometers per hour and of an overall length generally under about 25 meters, the method comprising the steps of:

providing a small fin-rudder located under the forward portion of the boat's keel, mounting said fin-rudder to a rotatable shaft capable of rotating said fin-rudder a maximum of about thirty degrees either side of the neutral position of said fin-rudder's fore and aft alignment with said keel, rotating said fin-rudder in the direction of said boat's undesired list, for exerting a steering force altering the boat's heading, and also exerting a leveling force around its roll axis, simultaneously changing the direction of thrust of said boat's driving and steering unit to offset the steering force of said fin-rudder in order to maintain the boat's heading, utilizing the banking force around the boat's roll axis resulting from the change of direction of thrust of the boat's driving and steering unit together with the lesser additional force from said fin-rudder, for maintaining an average level attitude for said boat around its roll axis while maintaining the boat's heading, including a further step of:

employing an electronic output of a gravity inclinometer to measure inclination of said boat about its roll axis, by said electronic output automatically actuating a servo mechanism attached to said fin-rudder shaft, for altering the angle-of-attack of said fin-rudder, including an additional step of:

feeding said electronic output of said gravity inclinometer through an electronic filter for providing a modified signal that gives the powerboat's average attitude around its roll axis, and automatically actuating said servo mechanism by said modified signal.

7. The method of controlling the average list of a forward-moving powerboat capable of speeds in excess of about 20 kilometers per hour and having an overall length under about 25 meters comprising the steps of:

providing a fin-rudder with a shaft fixed to the fin-rudder and projecting above the fin-rudder;

mounting the shaft extending up through a forward portion of a keel of a hull of a powerboat into an interior of the hull in rotatable watertight relation to the hull;

selectively adjusting angular positioning of said shaft as seen from above for turning the fin-rudder as seen from above into angular relationship with respect to a longitudinal centerline of the hull within an angular range from a neutral position of zero degrees with respect to the centerline to about 30° either clockwise or counterclockwise from zero degrees for adjusting angle-of-attack of the fin-rudder within said angular range relative to oncoming water resulting from forward-moving of the powerboat;

adjusting the angle-of-attack of the fin-rudder into a clockwise angular relationship within said range as seen from above for opposing a list of the powerboat toward starboard by exerting thereby a steering force toward starboard, while also exerting a banking force toward leveling in a counterclockwise direction around a roll axis of the powerboat as seen from astern of the powerboat;

turning a submerged driving and steering unit of the powerboat toward a clockwise angular relationship as seen from above for exerting a steering force toward port for offsetting said steering force of the fin-rudder toward starboard, while also exerting a banking force toward leveling in a counterclockwise direction around said roll axis as seen from astern in major addition to said banking force toward leveling being exerting in said counterclockwise direction around said roll axis by said fin-rudder;

adjusting the angle-of-attack of the fin-rudder into a counterclockwise angular relationship within said range as seen from above for opposing a list of the powerboat toward port, while also exerting a banking force toward leveling in a clockwise direction around said roll axis of the powerboat as seen from astern; and turning the submerged driving and steering unit of the powerboat toward a counterclockwise angular relationship as seen from above for offsetting said steering force of the fin-rudder toward port, while also exerting a banking force toward leveling in a clockwise direction around said roll axis as seen from astern in major addition to said banking force toward leveling being exerted in said clockwise direction around said roll axis by said fin-rudder.

8. The method of controlling the average list of a forward-moving powerboat as claimed in claim 7, wherein:

adjusting the angle-of-attack of the fin-rudder is manually controlled.

9. The method of controlling the average list of a forward-moving powerboat as claimed in claim 7, wherein:

adjusting the angle-of-attack of the fin-rudder and turning the driving and steering unit are substantially simultaneous.

10. The method of controlling the average list of a forward-moving powerboat as claimed in claim 7, wherein:

adjusting the angle-of-attack of the fin-rudder is automatically controlled by a gravity inclinometer.

11. The method of controlling the average list of a forward-moving powerboat as claimed in claim 7, wherein:

adjusting the angle-of-attack of the fin-rudder is automatically controlled by a gravity inclinometer; and turning the driving and steering unit is automatically controlled by a compass.

12. The method of controlling the average list of a forward-moving powerboat as claimed in claim 7, wherein:

turning of the driving and steering unit is adjustably proportioned relative to adjusting the angle-of-attack of the fin-rudder for causing angular turning of the driving and steering unit to be proportionately less than angular adjusting the angle-of-attack of the fin-rudder.

13. The method of controlling the average list of a forward-moving powerboat as claimed in claim 7, wherein:

prior to adjusting the angle-of-attack of the fin-rudder, an initial heading of the powerboat is determined; and turning of the driving and steering unit is proportioned relative to the steering force exerted from adjusting the angle-of-attack of the fin-rudder for matching a current heading of the powerboat with said determined initial heading of the powerboat.

14. The method of controlling the list of a forward-moving powerboat capable of speeds in excess of about 20 kilometers per hour and having an overall length under about 25 meters comprising the steps of:

providing a fin-rudder with a shaft fixed to the fin-rudder and projecting above the fin-rudder;

mounting the shaft extending up through a forward portion of a keel of a hull of a powerboat into an interior of the hull in rotatable watertight relation to the hull;

selectively rotating said shaft as seen from above for turning the fin-rudder into angular relationship with respect to a longitudinal centerline of the hull within an angular range from a neutral position of zero degrees to about 30° either side of zero degrees;

turning the fin-rudder into a clockwise angular relationship within said range as seen from above for opposing a list of the boat toward starboard by exerting thereby a steering force toward starboard, while also exerting a force toward leveling in a counterclockwise direction around a roll axis of the boat as seen from astern of the boat;

turning a driving and steering unit of the boat toward a clockwise angular relationship as seen from above for offsetting said steering force toward starboard, while also exerting a force toward leveling in a counterclockwise direction around said roll axis as seen from astern in major addition to said force toward leveling being exerting in said counterclockwise direction by said fin-rudder;

turning the fin-rudder into a counterclockwise angular relationship within said range as seen from above for opposing a list of the boat toward port, while also exerting a force toward leveling in a clockwise direction around said roll axis as seen from astern;

turning the driving and steering unit of the boat toward a counterclockwise angular relationship as seen from above for offsetting said steering force toward port, while also exerting a force toward leveling in a clockwise direction around said roll axis as seen from astern in major addition to said force toward leveling being exerted in said clockwise direction by said fin-rudder, and linking turning of the fin-rudder with turning of the driving and steering unit in adjustable proportionately predetermined relationship for causing turning of the driving and steering unit to be reduced by an adjusted predetermined steering ratio relative to turning of the fin-rudder.

15. In a powerboat comprising a hull, a keel, and a driving and steering unit positioned near the powerboat's stern which banks the powerboat when its angle of thrust is changed from center, apparatus comprising:

a generally vertical fin-rudder having a shaft fixed to the fin-rudder and projecting upwardly above the fin-rudder, said shaft extending upwardly through a forward portion of said keel and being connected to shaft-turning apparatus within the hull for turning the fin-rudder through an angular range as seen from above of about 30° clockwise and counterclockwise from fore and aft alignment of the fin-rudder with said keel as seen from above, said shaft having a suitable water seal for preventing water from entering the hull alongside said shaft;

a gravity inclinometer in circuit with said shaft-turning apparatus for controlling turning of the fin-rudder within said range in response to average listing of the powerboat about its roll axis for exerting a banking force about the roll axis in a direction toward leveling of the average listing; and a compass controlling thrust direction of the driving and steering unit for turning the direction of thrust of the driving and steering unit for compensating for steering effect resulting from turning of the fin-rudder for maintaining heading of the powerboat and for providing a banking force about the roll axis in said direction toward leveling of the average listing for cooperating with the fin-rudder toward leveling of the powerboat.

16. In a powerboat comprising a hull, a keel, and a driving and steering unit which banks said boat when its angle of thrust is changed from center, apparatus comprising:

a generally vertical fin-rudder having a shaft fixed to the fin-rudder and projecting upwardly above the fin-rudder;

said shaft extending upwardly through a forward portion of said keel and being connected to shaft-turning apparatus within the hull for turning the fin-rudder through an angular range of about 30° clockwise and counter-clockwise from fore and aft alignment of the fin-rudder with said keel;

said shaft having a suitable water seal for preventing water from entering the hull alongside said shaft;

a gravity inclinometer in circuit with said shaft-turning apparatus for controlling turning of the fin-rudder within said range in response to average listing of the boat about its roll axis; and an electronic filtering and averaging circuit associated with said gravity inclinometer for providing to said shaft-turning apparatus an average control signal which is substantially free from fluctuations caused by momentary excursions of the boat around its roll axis.

17. In a powerboat comprising a hull, a keel, and a driving and steering unit which banks said boat when its angle of thrust is changed from center, apparatus comprising:

a generally vertical fin-rudder having a shaft fixed to the fin-rudder and protecting upwardly above the fin-rudder;

said shaft extending upwardly through a forward portion of said keel and being connected to shaft-turning apparatus within the hull for turning the fin-rudder through an angular range of about 30° clockwise and counter-clockwise from fore and aft alignment of the fin-rudder with said keel;

said shaft having a suitable water seal for preventing water from entering the hull alongside said shaft;

a gravity inclinometer in circuit with said shaft-turning apparatus for controlling turning of the fin-rudder within said range in response to average listing of the boat about its roll axis; and a helm-to-steering-unit linkage and a fin-rudder linkage cooperate to change in a predetermined ratio the angle of thrust of the boat's driving and steering unit without disturbing an operator's control of the boat's helm.

18. The apparatus as claimed in claim 15, in which:

a helm-to-steering-unit linkage and a fin-rudder linkage cooperate to change in a predetermined ratio the angle of thrust of the boat's driving and steering unit without disturbing an operator's control of the boat's helm; and said helm-to-steering-unit linkage is adjusted in its path length by said fin-rudder linkage.

19. In a powerboat comprising a hull, a keel, and a driving and steering unit which banks said boat when its angle of thrust is changed from center, apparatus comprising:

a generally vertical fin-rudder having a shaft fixed to the fin-rudder and protecting upwardly above the fin-rudder;

said shaft extending upwardly through a forward portion of said keel and being connected to shaft-turning apparatus within the hull for turning the fin-rudder through an angular range of about 30° clockwise and counter-clockwise from fore and aft alignment of the fin-rudder with said keel;

said shaft having a suitable water seal for preventing water from entering the hull alongside said shaft;

a gravity inclinometer in circuit with said shaft-turning apparatus for controlling turning of the fin-rudder within said range in response to average listing of the boat about its roll axis; and two loosely sheathed flexible cables, the second of which cables with its sheath is free to follow a non-straight path, said two cables being so arranged that the first said cable adjusts the path-length of the second said cable by moving the sheath of said second cable, the result being a longitudinal mechanical output that is a summation of actions of the two said cables for the purpose of steering a boat.

20. The apparatus as claimed in claim 19, in which:

at least one of said cables is replaced by an electrical linkage.

21. The apparatus as claimed in claim 15, in which:

said shaft-turning apparatus for turning the fin-rudder comprises an electric-powered servo mechanism.

22. The apparatus as claimed in claim 21, in which:

said electric-powered servo mechanism for turning the fin-rudder is remote from the fin-rudder.

23. The apparatus as claimed in claim 15, in which:

said shaft-turning apparatus for turning the fin-rudder comprises a hydraulic-powered servo mechanism.

24. The apparatus as claimed in claim 15, wherein:

said compass for controlling the thrust direction of the driving and steering unit is a magnetic flux-gate compass for maintaining the powerboat on an existing heading only during a period of time during which the fin-rudder is undergoing turning.

25. The apparatus as claimed in claim 15, in which:

said shaft penetrates the hull at a point located in a range from about 15 percent to about 45 percent of the powerboat's waterline length back from the most forward immersible point of the powerboat's hull when the powerboat is underway.

26. The apparatus as claimed in claim 15, in which:

said fin-rudder has an area in square centimeters calculated by multiplying designed resting waterline length of the powerboat in meters by a number in a range from about 15 to about 65.

* * * * *